US005733696A

United States Patent [19]

Takahashi et al.

[11] Patent Number: 5,733,696

[45] Date of Patent: Mar. 31, 1998

[54] INVERTED-LAMINATION ORGANIC POSITIVE-PHOTOCONDUCTOR FOR ELECTROPHOTOGRAPHY

[75] Inventors: Akira Takahashi; Sumitaka Nogami, both of Nagano, Japan

[73] Assignee: Fuji Electric Co., Ltd., Kawasaki, Japan

[21] Appl. No.: 719,023

[22] Filed: Sep. 24, 1996

[30] Foreign Application Priority Data

Sep. 26, 1995 [JP] Japan ..... 7-247086

[51] Int. Cl.[6] ..... G03G 8/00

[52] U.S. Cl. ..... 430/59; 430/66

[58] Field of Search ..... 430/58, 59, 66, 430/96

[56] References Cited

U.S. PATENT DOCUMENTS

| | | | |
|---|---|---|---|
| 5,418,099 | 5/1995 | Mayama et al. | 430/58 |
| 5,455,135 | 10/1995 | Maruyama et al. | 430/58 |

FOREIGN PATENT DOCUMENTS

| | | |
|---|---|---|
| 1015748 | 5/1976 | Japan . |
| 8121044 | 7/1983 | Japan . |
| 9223445 | 12/1984 | Japan . |
| 60-055357 | 3/1985 | Japan . |
| 1022345 | 1/1986 | Japan . |
| 63-015446 | 1/1988 | Japan . |

OTHER PUBLICATIONS

Donald R. Askeland; The Science And Engineering Of Materials, Third Edition, PWS Publishing Company, Boston, Chapter 20, pp. 670–700.

Richard C. Dorf, editor–in–chief; The Electrical Engineering Handbook, CRC Press, Ann Arbor, MI, Chapter 83.2, pp. 1958–1964.

The Journal of the Chemical Society, Chemical Communication, (1989), p. 1736ff.; Soluble And High Molecular Weight Polyaniline.

Synthetic Metals, 21 (1987), p. 21ff.; Polyaniline: Processability From Aqueous Solutions And Effect Of Water Vapor On Conductivity.

The Society for Imaging Science and Technology, Proceedings of The Third International Congress on Advances in Non–impact Printing Technologies, p. 113ff.; The Metering Of Ink In The Grooves Of A Gravure Roll.

The Society of Electrophotography, Proceedings of the 59th Technical Meeting, p. 184ff.

*Primary Examiner*—John Goodrow

*Attorney, Agent, or Firm*—Morrison Law Firm

[57] ABSTRACT

An inverted-lamination organic positive-photoconductor for electrophotography comprises a conductive substrate, a charge transport layer on the conductive substrate, a charge generation layer on the charge transport layer, a surface protection layer on the charge generation layer, with the surface protection layer containing a polyaniline compound which includes being doped with a protonic acid selected from a sulfonic acid, a carboxylic acid, an organophosphoric acid, or a potential compound, wherein the potential compound is a compound that reacts to form one of a sulfonic acid, a carboxylic acid, or an organophosphoric acid.

16 Claims, 3 Drawing Sheets

INVERTED-LAMINATION ORGANIC POSITIVE-PHOTOCONDUCTOR FOR ELECTROPHOTOGRAPHY

BACKGROUND OF THE INVENTION

The present invention relates to organic photoconductors for electrophotography. More specifically the present invention relates to photoconductors suitable to be charged positively and having a laminated surface protection film.

The interaction of electromagnetic radiation in the form of waves or particles of energy called photons with various materials can be utilized in a large number of applications. A review of basic principals of photon interaction with materials is found in Donald R. Askeland *The Science and Engineering of Materials, Third Edition*, PWS Publishing Company, Boston, Chapter 20, pages 670–700, the entirety of which is incorporated herein by reference.

Electrophotography utilizes materials which show a change in electrical conductivity during light exposure. The basis for utilizing the principal of electrophotography in printing apparatus and copy machines is reviewed in Richard C. Doff, editor-in-chief, *The Electrical Engineering Handbook*, CRC Press, Ann Arbor, Mich., Chapter 83.2, pages 1958–1964, the entirety of which is incorporated herein by reference.

Photoconductors, used in electrophotographic apparatus such as copying machines or in printers that employ the electrophotographic technique, typically include a conductive substrate and a photoconductive layer laminated on the conductive substrate. Traditionally, Inorganic photoconductive materials such as selenium, selenium alloys, zinc oxide and cadmium sulfide have been used for such photoconductors for electrophotography.

Recently, photoconductors which use organic photoconductive materials have been developed. Motivation for developing organic photoconductors has been principally due to such organic materials' lower toxicity, their ease of film formation, their light weight, and their low cost.

Among the organic photoconductors, the so-called function-separation-type photoconductors have two essential layers: a photoconductive layer consisting of a charge generation layer for generating carriers in response to received light, and a charge transport layer for transporting the generated carries.

Function-separation-type photoconductors have many merits. One important feature of function-separation-type photoconductors is that the sensitivity or spectroscopic sensitivity may be greatly improved by selecting for each layer a material that is appropriately matched to optimally respond to the wavelength of the exposure light. Due to these merits, the function-separation-type photoconductors have already been used in the electrophotographic apparatuses such as copying machines, printers, and facsimile copiers.

The most popular function-separation-type photoconductors have a laminate structure consisting of a conductive substrate and a photoconductive layer. The photoconductive layer has a charge generation layer that is laminated on the conductive substrate and a charge transport layer laminated on the charge generation layer.

Since electron donors, such as pyrazoline compounds, hydrazone compounds, oxazole compounds and carbazole compounds, usually are used as the charge transport agent for the laminate-type photoconductor, the charge transport layer of the laminate-type photoconductor is of hole transport type. Consequently, when the charge transport layer is laminated on the charge generation layer, the charge transport layer is charged up to be negatively charged.

Once a photoconductor is installed in its intended device, it is subjected to the many rapidly repeated cycles inherent to electrophotographic processes. These processes consist of the steps of charging-up, exposing to light, developing, printing, cleaning, and discharging. The charging-up step can be either positive or negative charging. However, the use of positive charging stabilizes corona discharge and reduces ozone production. Hence, positive charging reduces the deterioration of the photoconductor from ozone induced oxidation.

The conventional inorganic photoconductors, made of selenium, selenium alloy, or such inorganic photoconductive materials, are used in applications directed toward utilizing a positive charge in the charging-up step. The electrophotographic process used for such inorganic photoconductors should be applicable to organic photoconductors, if an organic photoconductor capable of accepting the positively charged-up state (hereinafter referred to as a "positive organic-photoconductor") were delineated.

Such a positive organic-photoconductor would have a charge transport layer laminated on the charge generation layer. Electron acceptors such as trinitrofluorenone could be used as the charge transport agent. However, such electron acceptors have not been used widely, since the mobility of the electron acceptor is limited. Moreover, such electron acceptors are toxic and chemically unstable.

To obtain a positive organic-photoconductor which uses an electron donor, it has been proposed to form a charge transport layer on a substrate, and then a charge generation layer on the charge transport layer. This order of lamination has been sometimes referred to as an "inverted lamination" or "inverted structure").

One drawback of inverted structure organic photoconductors is that carrier injection occurs vigorously and lowers the charging capability of the photoconductor. Further, when the relatively thin charge generation layer is the outermost surface layer, the inverted lamination exhibits insufficient mechanical strength and insufficient durability.

To overcome these drawbacks, several structures have been proposed. Two proposed structures include a triple-layer structure and a quadruple-layer structure. The triple-layer structure laminates a charge transport layer, a charge generation layer on the charge transport layer and a surface protection layer on the charge generation layer. The quadruple-layer structure laminates a charge transport layer, a charge injection blocking layer, a charge generation layer and a surface protection layer. There are also proposed a double-layer structure which improves the mechanical strength by thickening the charge generation layer by increasing the resin content, and a double-layer structure which attempts to maintain the sensitivity by adding the charge transport agent to the charge generation layer. More detailed descriptions of these proposals can be found in *Proceedings of the 3rd International Congress for Advances in Non-Impact Printing Technologies*, p 115, the entirety of which is incorporated herein by reference, and *Proceedings of the 59th Technical Meeting of The Society of Electrophotography*, p 184, the entirety of which is incorporated herein by reference.

Further, polyester resin, polyvinyl butyral resin, phenol resin, cellulose acetate resin, styrene maleic arthydride copolymer, polyamide resin, polyimide resin and melamine resin have been proposed for the protection layer of the photoconductor. See Japanese Examined Patent Publications (Koukoku) No. S51-15748, and Japanese Unexamined Laid Open Patent Publications (Kokai) No. S63-15446, S60-55357, and S61-22345, the entirety of which are each incorporated herein by reference. However, the durability of these resins, such as resistance against damaging by repeated use or wear resistance, is not always sufficient. Further, if the film thickness is increased to improve the durability, the remanent potential of the photoconductor is increased, or the repeatability is deteriorated.

Protection films which contain metal oxide dispersed in the resin binder have also been proposed. See Japanese Unexamined Laid Open Patent Publications No. H58-121044, and H59-223445, the entirety of which are each incorporated herein by reference. However, since metal oxide is insoluble to the binder resin and solvent, and since metals oxide distribute in clusters in the protection layer, either uniformity of the resistance value of the protection film is lost, or the properties of the protection film becomes unstable in correspondence with the distribution state of the metal oxide. These problems occur even when the content of the metal oxide in the protection film is fixed. Furthermore, when the content and grain diameter of the metal oxide is finely adjusted to overcome these drawbacks, the properties of the protection film may be varied by repeated use of the photoconductor.

Accordingly, no positive organic-photoconductor, which exhibits satisfactory sensitivity and durability and can be used under the positively charged up state, has thus far been realized, and problems remain unsolved.

In a structure which laminates a charge generation layer on a charge transport layer and exhibits sensitivity upon positive charging-up, the holes generated in the charge generation layer are injected to the charge transport layer. However, it takes time for the electrons to travel in the surface protection layer. Since the electrons are substantially trapped in the protection layer, the remanent potential rises. When a conductive film is used for the protection film, surface charges are injected to the conductive protection layer to lower the retention rate. Therefore, another problem is posed by the charge lowering by repeated use under high temperature and high humidity. Moreover, thin conductive protection films do not exhibit acceptable durability.

OBJECTS AND SUMMARY OF THE INVENTION

In view of the foregoing problems with the prior art, it is an object of the invention to provide an organic photoconductor for electrophotography which includes a charge transport layer, a charge generation layer, and a surface protection layer laminated one by one in the sequence of this description.

It is an object of the invention to provide an organic photoconductor for electrophotography which exhibits less remanent potential rise and less charge lowering in the temperature/humidity range from low temperature-low humidity to high temperature-high humidity while demonstrating excellent wear resistance and durability.

According to an aspect of the invention, there is provided a photoconductor for electrophotography which includes a conductive substrate, a charge transport layer on the conductive substrate, a charge generation layer on the charge transport layer, and a surface protection layer on the charge generation layer. The surface protection layer contains a polyaniline compound represented by the following general formula (1):

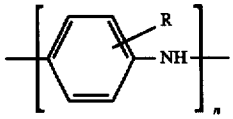

(1)

wherein R represents one member selected from the group consisting of a hydrogen atom, halogen atom, nitro-group, nitryl-group, cyano-group, alkyl-group, aryl-group, and alkoxy-group; and n represents a positive integer.

Advantageously, the polyaniline compound represented by general formula (1) is polyaniline or polyorthoanisidine.

Preferably, the polyaniline compound represented by general formula (1) is doped with protonic acid. The dopant includes a member selected from the group consisting of sulfonic acid, carboxylic acid, organophosphoric acid and a potential compound of sulfonic acid, carboxylic acid or organophosphoric acid.

The term "potential compound" is used herein to represent such compounds which are well known to chemists that, although not in of themselves the specified acids, will form the specified acids consisting of sulfonic acid, carboxylic acid, or organophosphoric acid. Such potential compounds would form the specified acids by reactions well known to chemists. Such reactions include oxidation or hydrolysis. Such potential compounds include, for example, phosphoric esters $(RO)PO(OH)_2$, ammonium phosphate, and sulfonic esters $RSO_3R$, and sulfonates $RSO_3M$ where R is an alkyl group or an aryl group and M is a metal.

By providing a photoconductor for electrophotography with a surface protection layer which includes a polyaniline compound represented by general formula (1) or a polyaniline compound doped with a protonic acid, the photoconductor of the present invention exhibits substantial sensitivity under positive charging-up, less residual potential rise after repeated use, excellent wear resistance and excellent durability.

Briefly stated, an inverted-lamination organic positive-photoconductor for electrophotography comprises a conductive substrate, a charge transport layer on the conductive substrate, a charge generation layer on the charge transport layer, a surface protection layer on the charge generation layer, with the surface protection layer containing a polyaniline compound which includes being doped with a protonic acid selected from a sulfonic acid, a carboxylic acid, an organophosphoric acid, or a potential compound, wherein the potential compound is a compound that reacts to form one of a sulfonic acid, a carboxylic acid, or an organophosphoric acid.

According to an embodiment of the present invention, a photoconductor for electrophotography comprises a conductive substrate, a charge transport layer on the conductive substrate, a charge generation layer on the charge transport layer, a surface protection layer on the charge generation layer, the surface protection layer containing a polyaniline compound represented by the following general formula (1):

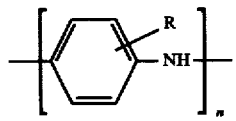

(1)

wherein R represents one member selected from the group consisting of a hydrogen atom, halogen atom, nitro-group, nitryl-group, cyano-group, alkyl-group, aryl-group, and alkoxy-group, and wherein n represents a positive integer.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
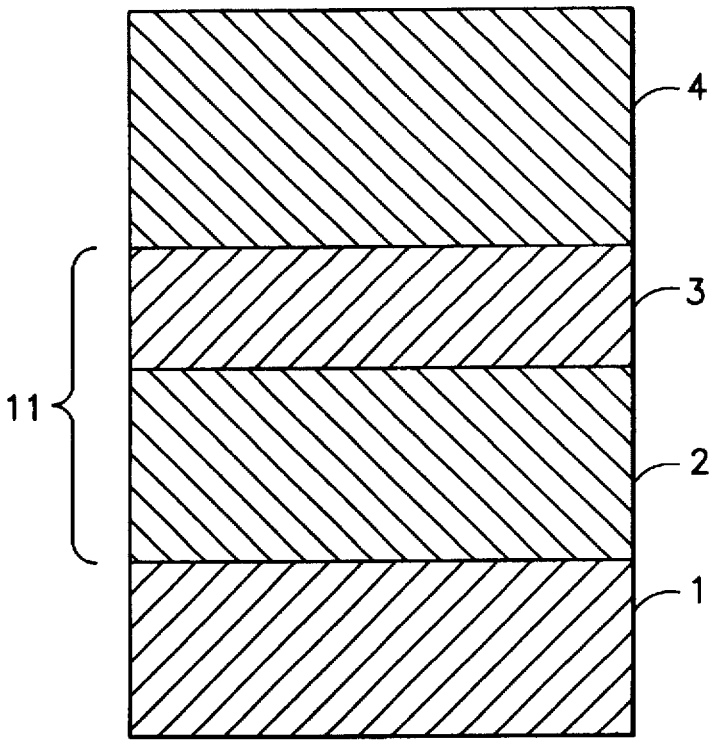
FIG. 1 is a cross section of a photoconductor for electrophotography according to the present invention.

Referring to FIG. 1, a photoconductor for electrophotography according to the present invention includes a charge transport layer 2 laminated on a conductive substrate 1, a charge generation layer 3 laminated on charge transport layer 2, and a surface protection layer 4 formed on charge generation layer 3. Charge transport layer 2 and charge generation layer 3 form a photoconductive layer 11.

The method for synthesizing polyaniline, used in the present invention, of the polyaniline compound represented by general formula (1) is described in the *Journal of the Chemical Society, Chemical Communication*; (1989), p.1736, the entirety of which is incorporated herein by reference.

Polyaniline powder is first obtained by oxidatively polymerizing an aqueous solution of aniline and sulfuric acid at low temperature with ammonium peroxodisulfate as an oxidizing agent. The polyaniline, soluble to solvent, is obtained by neutralizing and purifying the thus obtained polyaniline powder with aqueous ammonia.

The structure of polyaniline, the polymer of the composition described by the general formula (1), has been reported in *Synthetic Metals*, Vol. 21, (1988), p.21, the entirety of which is incorporated herein by reference. However, polyaniline has also been variously described as a material which is hard to dissolve, melt, and process. Therefore, polyaniline has not been applied thus far to the surface protection layer of the photoconductor, since it has been considered to be too difficult to form a film which contains polyaniline.

Nevertheless, the present inventors have innovatively found that polyaniline and its derivatives exhibit excellent compatibility with binder resins, such as a polycarbonate resin, polyester resin, polyamide resin, polystyrene resin, vinyl chloride resin, vinyl acetate resin, (meth) acrylic resin, polyvinyl butyral, polyvinyl acetat, and polyvinyl formal.

The photoconductor of the present invention includes a surface protection layer formed by coating a coating liquid in which a soluble polyaniline or a soluble polyorthoanisidine and one of the above described binder resin are mixed. The thus manufactured photoconductor of the invention exhibits substantial sensitivity under positive charging-up, less residual potential rise after repeated use, excellent wear resistance, and excellent durability. An extremely small amount, e.g. only several weight percent, of polyaniline is sufficiently effective to produce the above described desirable properties.

The surface protection layer of the invention is preferably from about 0.1 to about 20 μm, and more preferably from about 0.5 to about 15 μm in thickness. Although an extremely small amount of polyaniline compound is effective as described above, preferably the amount of polyaniline is about 5 weight % or more.

When the surface protection layer contains from about 5 to about 50 weight % of polyaniline compound, it is preferable to dip a surface protection layer formed in advance in protonic acid solution or to form a surface protection layer by using a coating liquid which contains from about 1 to about 200 weight %, preferably from about 5 to about 150 weight parts, of the protonic acid for enhancing the functions of the surface protection layer.

As a result of investigation on the compatibility of protonic acid with the surface protection layer, it has been found that sulfonic acid, carboxylic acid, organophoshoric acid, and potential compounds are preferable.

The photoconductor of the invention is of a function separation-type which laminates a charge transport layer on a conductive substrate, a charge generation layer on the charge transport layer and a surface protection layer on the charge generation layer.

The charge transport layer is formed by coating and drying a coating liquid for the charge transport layer containing poly(N-vinylcarbazole), poly(vinylanthracene), polysilane, or such similar polymers. The coating liquid for the charge transport layer is prepared also by dissolving a low molecular weight compound (molecular weight less than approximately several hundred) such as a hydrazone compound, pyrazoline compound, enamine compound, styryl compound, arylmethane compound, arylamine compound, butadiene compound, or diazo compound, with a binder for facilitating film formation into an organic solvent.

The binder includes polycarbonate resin, polyester resin, polyethylene resin, (meth) acrylic resin, and silicone resin. From 50 to 200 weight parts of the binder is used for 100 weight parts of the low-molecular-weight compound.

The charge transport layer is preferably from about 10 to about 30 μm in thickness.

The charge generation layer is formed by coating and drying a charge generating agent alone or an organic solvent in which a charge generating agent and a binder are dispersed. The charge generating agent includes an azo pigment, anthraquinone pigment, polycyclic quinone pigment, indigo pigment, diphenylmethane pigment, azine pigment, cyanine pigment, perylene pigment, squalane pigment, and phthalocyanine pigment.

The binder for the charge generation layer includes polyamide resin, silicone resin, polyester resin, polycarbonate resin, phenoxy resin, polystyrene resin, polyvinyl butyral resin, polyvinyl formal resin, polyvinyl acetal resin, (meth) acrylic resin, and vinyl chloride resin. From about 5 to about 200 weight parts, more preferably from about 10 to about 100 weight parts, of the binder resin is used alone or in combination with respect to 100 weight parts of the charge generating agent.

The charge generation layer is preferably from about 0.05 to about 2.0 μm in thickness.

First Embodiment

Polyaniline was synthesized as follows.

A first solution was prepared by adding 98 weight parts of sulfuric acid and 93 weight parts of aniline to 1000 weight parts of distilled water. The first solution was cooled down to −5° C. A second solution, which contains 196 weight parts of sulfuric acid and 196 weight parts of ammonium peroxodisulfate added to 1000 weight parts of distilled water, was added slowly to the first solution while stirring and cooling at −5° C.

After cooling for a whole day and night, a dark blue precipitate was produced. This precipitate was washed with distilled water, and then with aqueous ammonia until the sulfuric acid radical was not detected any more. Then, the dark blue polyaniline was obtained by further washing the precipitate with distilled water and drying.

The thus obtained polyaniline is well soluble to a solvent N-methyl-2-pyrrolidone (hereinafter referred to as "NMP") up to 8 weight %, and a blue solution is thus obtained. The average molecular weight Mw of the polyaniline, measured by the gel permeation chromatography (GPC) in the NMP solvent containing 0.01 mol/cm3 of LiBr, was one hundred and fifty thousand (conversion to polystyrene).

Polyorthoanisidine was synthesized as follows.

A first solution, which contains 250 weight parts of o-anisidine and 2056 weight parts of 36% aqueous hydrochloric acid added to 1000 weight parts of distilled water, was prepared, and cooled down to 10° C. or lower. Then, a second solution was prepared by slowly adding 13896 weight parts of 33.3% aqueous ammonium persulfate to the first solution while stirring and cooling at 10° C. or lower. After continuing the reaction for 2 hr, the second solution was filtered under suction, and the filtered cake was dispersed. The cake was washed with pure water, decanted, left for whole day and night, and filtered again.

Polyorthoanisidine was obtained by repeatedly washing the cake with water until a pH 6 of the filtrate was attained, and by drying the cake at 30° C. by air. The thus obtained polyanisidine is well soluble to NMP up to 8 weight %, and a yellowish brown solution was obtained. The average molecular weight of the polyanisidine, measured by the gel permeation chromatography (GPC) in the NMP solvent containing 0.01 mol/cm3 of LiBr, was 1100.

The conductive substrate in the test example was 60 mm in its outer diameter, 56 mm in its inner diameter, 298 mm in length, and having a surface roughness of 1.0 μm in the maximum height $R_{max}$. The charge transport layer 2 was formed on conductive substrate 1 of the test example by the following procedure.

Figure 2:
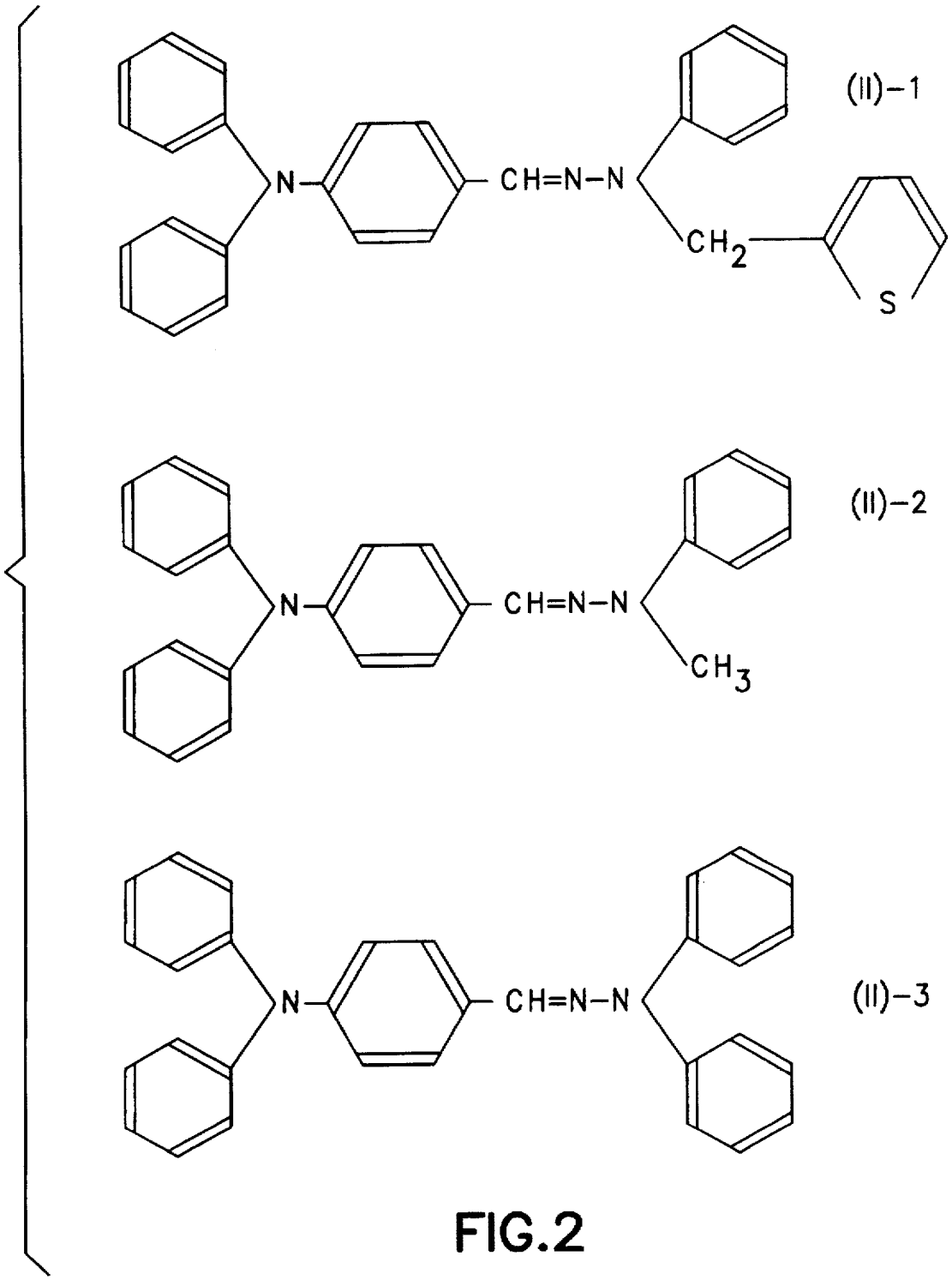
FIG. 2 shows chemical formulas representative of hydrazone compounds contained in the charge transport layer of the present invention.

A coating liquid for the charge transport layer was prepared by dissolving 10 weight parts of a hydrazone compound, described by chemical formula (II-1) in FIG. 2, and 10 weight parts of a polycarbonate resin (IUPILON PCZ-300 supplied from MITSUBISHI GAS CHEMICAL CO., INC.) into 80 weight parts of tetrahydrofuran. The charge transport layer was formed to a thickness of 20 μm on the conductive substrate by dip-coating the coating liquid.

Figure 3:
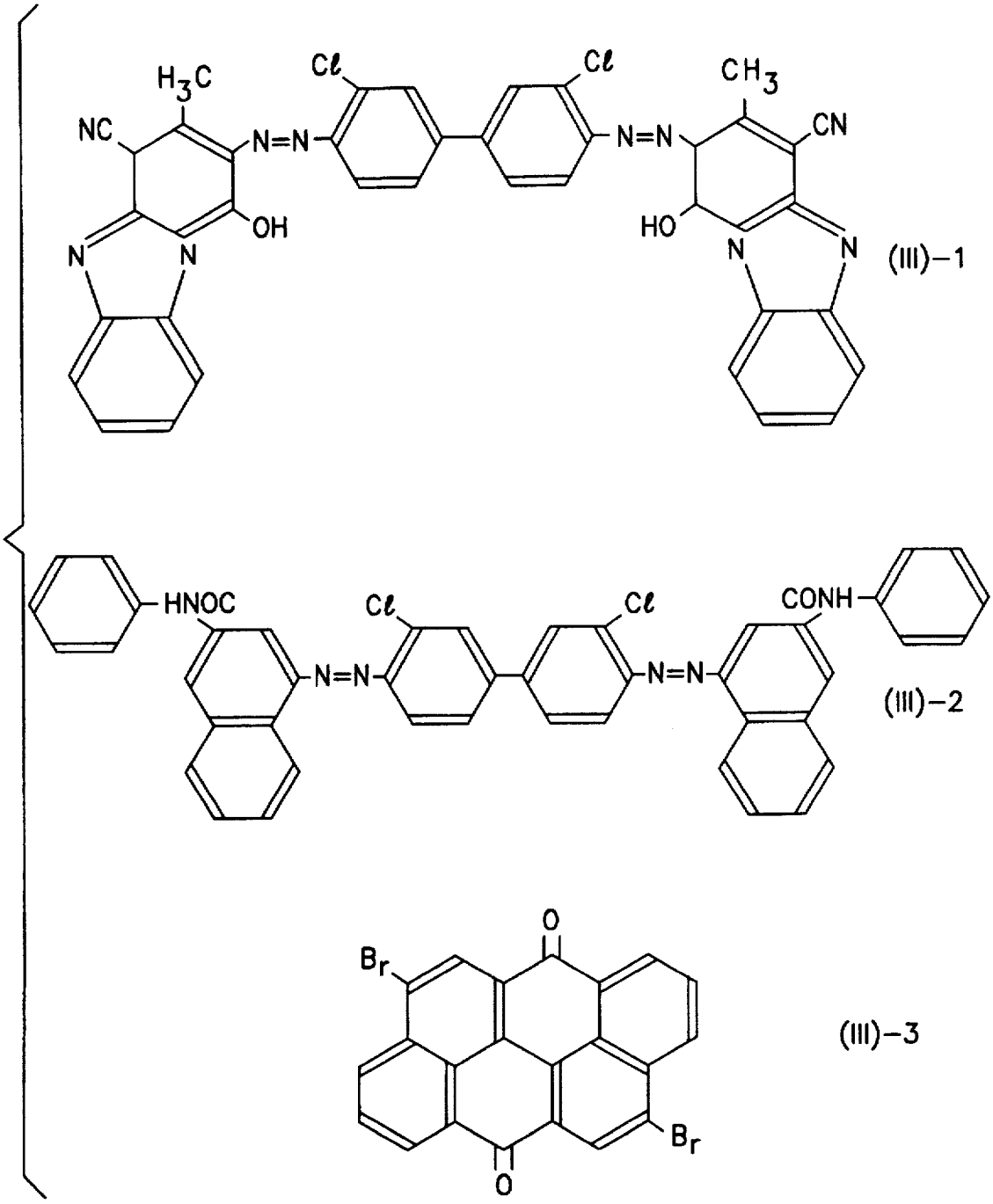
FIG. 3 shows chemical formulas representative of azo compounds contained in the charge generation layer of the present invention.

A coating liquid for the charge generation layer was prepared by dispersing 2.1 weight parts of an azo compound described by chemical formula (III-1) in FIG. 3 and 1.0 weight part of polyvinyl acetal (S.LEC KS-1 supplied from Sekisui Chemical Co., Ltd.) into 16 weight parts of methanol and 4 weight parts of methyl ethyl ketone in a sand mill, and by further adding 60 weight parts of methanol and 20 weight parts of normal butanol. A charge generation layer was formed on the charge transport layer by dip-coating the coating liquid and by subsequent drying to a thickness of 0.2 μm.

A protection layer was formed to a thickness of 5.0 μm by dip-coating a coating liquid prepared by dissolving 8 weight % of polyaniline, obtained as described earlier, into NMP.

Second Embodiment

The charge transport agent and charge generating agent of the first embodiment were replaced, respectively, by a hydrazone compound described by a chemical formula (II-2) in FIG. 2 and an azo compound described by chemical formula (III-2) in FIG. 3. A coating liquid for the protection layer was prepared by adding, to the coating liquid of the first embodiment, a double amount of polycarbonate resin (IUPILON PCZ-300 supplied from MITSUBISHI GAS CHEMICAL, INC.) to the polyaniline content of the first embodiment and 10 weight % of camphorsulfonic acid with respect to the polyaniline content of the first embodiment.

Third Embodiment

The charge transport agent and charge generating agent of the first embodiment were replace by a hydrazone compound described by chemical formula (II-3) in FIG. 2 and a dibromoanthanthrone compound described by chemical formula (III-3) in FIG. 3, respectively. Furthermore, a coating liquid for the second protection layer was prepared by adding, to the coating liquid of the first embodiment, a triple amount of polycarbonate (IUPILON PCZ-300 supplied from MITSUBISHI GAS CHEMICAL, INC.) to the polyaniline content of the first embodiment and 20 weight % of bis(2-ethylhexyl)hydrogenphosphate with respect to the polyaniline content of the first embodiment.

Fourth Embodiment

A fourth embodiment of a photoconductor was fabricated in the same manner as in the first embodiment except that polyaniline in the protection layer of the first embodiment was replaced by 8 weight % of polyorthoanisidine dissolved to NMP.

Fifth Embodiment

A fifth embodiment of a photoconductor was fabricated in the same manner as in the second embodiment except that polyaniline in the protection layer of the second embodiment was replaced by 8 weight % of polyorthoanisidine dissolved to NMP.

Sixth Embodiment

A sixth embodiment of a photoconductor was fabricated in the same manner as in the third embodiment except that polyaniline in the protection layer of the third embodiment was replaced by 8 weight % of polyorthoanisidine dissolved to NMP.

Seventh Embodiment

A seventh embodiment of a photoconductor was fabricated in the same manner as in the first embodiment except that the camphorsulfonic acid as the protonic acid of the first embodiment was replaced with 10 weight % of sulfuric acid.

Comparative Example 1

A comparative example 2 of a photoconductor was fabricated in the same manner as in the first embodiment except that the coating liquid for the surface protection layer included 5 weight parts of polyamide copolymer resin (Amilan CM-8000 supplied from TORAY INDUSTRIES, INC.) and 100 weight parts of methanol. The surface protection layer of the comparative example 1 does not contain polyaniline.

Comparative Example 2

A comparative example 2 of a photoconductor was fabricated in the same manner as in the first embodiment except that the first protection layer was not formed in the comparative example 2.

Testing

Electrophotographic properties of the thus fabricated photoconductors were evaluated in a process testing machine. The photoconductors were mounted on the testing machine, and charged at 600 V with a corotron while rotating at the circumferential speed of 60 mm/s. The potential when light was not irradiated was measured as the dark potential $V_O$. Then, the photoconductors were left in the dark for 5 sec, and the potential was measured to obtain the potential retention rate $V_{K5}$ (%). Then, light was irradiated from a halogen lamp to the photoconductor surface at the illuminance of 30 lx. The potential 0.2 sec later from the light irradiation was measured as the bright potential $V_L$. The potential 1.5 sec later was measured as the residual potential $V_R$. The above described charging and light exposure cycle was repeated ten thousand times, and the above described properties were measured during the first cycle (initial) and last cycle. Table 1 compares the results.

TABLE 1

| | Electrophotographic Properties | | | | | | | |
|---|---|---|---|---|---|---|---|---|
| | Initial | | | | After 1000 Cycles | | | |
| Photoconductors | $V_O$ (V) | $V_{K5}$ (%) | $V_L$ (V) | $V_R$ (V) | $V_O$ (V) | $V_{K5}$ (%) | $V_L$ (V) | $V_R$ (V) |
| 1st Embodiment | 621 | 91 | 40 | 15 | 580 | 88 | 50 | 20 |
| 2nd Embodiment | 610 | 90 | 45 | 10 | 585 | 88 | 55 | 15 |
| 3rd Embodiment | 615 | 92 | 50 | 12 | 581 | 90 | 60 | 19 |
| 4th Embodiment | 612 | 90 | 51 | 16 | 582 | 87 | 60 | 22 |
| 5th Embodiment | 607 | 93 | 42 | 12 | 590 | 88 | 52 | 20 |
| 6th Embodiment | 609 | 92 | 39 | 8 | 591 | 89 | 48 | 18 |
| 7th Embodiment | 605 | 85 | 60 | 30 | 570 | 79 | 80 | 40 |
| Comparative 1 | 602 | 90 | 55 | 25 | 580 | 85 | 100 | 45 |
| Comparative 2 | 580 | 80 | 40 | 15 | 480 | 75 | 50 | 25 |

The first and fourth embodiments contain, in the surface protection layer thereof, an undoped polyaniline compound. The second and fifth embodiments contain, in the surface protection layer thereof, a polycarbonate binder resin and a polyaniline compound doped with sulfonic acid. And, the third and sixth embodiments contain, in the surface protection layer thereof, a polycarbonate resin binder and a polyaniline compound doped with organophosphoric acid.

The first through sixth embodiment exhibit less charge lowering after repeated use, higher potential retention rate, and lower residual potential as compared with the comparative example 1 which includes a polycarbonate surface protection layer containing no polyaniline compound and the comparative example 2 having no surface protection layer.

If we compare the first through sixth embodiments with the seventh embodiment which contains, in the surface protection layer thereof, a polyaniline compound doped with sulfuric acid, i.e. inorganic acid, it is clear that the organic acid is superior to the inorganic acid as the dopant for the polyaniline compounds.

The photoconductor for electrophotography according to the present invention includes a conductive substrate, a charge transport layer on the conductive substrate, a charge generation layer on the charge transport layer, and a surface protection layer on the charge generation layer. The surface protection layer contains a polyaniline compound, described by the general formula 1 and doped with a protonic acid such as sulfonic acid, carboxylic acid, organophosphoric acid and a potential compound of these organic acids. The organic photoconductor of the invention is sensitive under positive charging. The photoconductor for positive charging of the invention exhibits less residual potential rise after repeated use, and excellent wear resistance.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

Although only a single or few exemplary embodiments of this invention have been described in detail above, those skilled in the art will readily appreciate that many modifications are possible in the exemplary embodiment (s) without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures. This although a nail and screw may not be structural equivalents in that a nail relies entirely on friction between a wooden part and a cylindrical surface whereas a screw's helical surface positively engages the wooden part in the environment of fastening wooden parts, a nail and a screw may be equivalent structures.

What is claimed is:

1. A photoconductor for electrophotography comprising:

a conductive substrate;

a charge transport layer on said conductive substrate;

a charge generation layer on said charge transport layer;

a surface protection layer on said charge generation layer;

said surface protection layer containing a substantially continuous phase of a polyaniline compound represented by the following general formula (1):

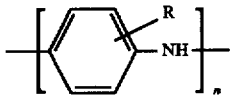

(I)

wherein R represents one member selected from the group consisting of a hydrogen atom, halogen atom, nitro-group, nitryl-group, cyano-group, alkyl-group, aryl-group, and alkoxy-group; and wherein n represents a positive integer.

2. The photoconductor according to claim 1, wherein said polyaniline compound represented by said general formula (1) is polyaniline.

3. The photoconductor according to claim 1, wherein said polyaniline compound represented by said general formula (1) is polyorthoanisidine.

4. The photoconductor according to claim 1, wherein said polyaniline compound represented by said general formula (1) is doped with protonic acid.

5. The photoconductor according to claim 4, wherein said protonic acid is one selected from the group consisting of sulfonic acid, carboxylic acid, organophosphoric acid, and potential compound, wherein said potential compound is a compound that reacts to form one of said sulfonic acid, said carboxylic acid, and said organophosphoric acid.

6. The photoconductor according to claim 1, wherein said surface protection layer further contains a binder which is a member selected from the group consisting of polycarbonate resin, polyester resin, polyamide resin, polystyrene resin, vinyl chloride resin, vinyl acetate resin, (meth) acrylic resin, polyvinyl butyral resin, polyvinyl acetal resin, and polyvinyl formal resin.

7. The photoconductor according to claim 1, wherein said surface protection layer is from about 0.1 μm to about 20 μm in thickness.

8. The photoconductor according to claim 1, wherein said surface protection layer is from about 0.5 μm to about 15 μm in thickness.

9. The photoconductor according to claim 1, wherein said polyaniline compound is in the amount of greater than about 5 wt %.

10. The photoconductor according to claim 1, wherein said polyaniline compound is in the amount of from about 5 wt % to about 50 wt %.

11. The photoconductor according to claim 1, wherein said charge transport layer is from about 10 μm to about 30 μm in thickness.

12. The photoconductor according to claim 1, wherein said charge transport layer includes a member selected from the group consisting of poly(N-vinylcarbazole), poly (vinylanthracene), polysilane, a hydrazone compound, a pyrazoline compound, a enamine compound, a styryl compound, a arylmethane compound, a arylamine compound, a butadiene compound, and a diazo compound.

13. The photoconductor according to claim 12, wherein said charge transport layer further includes a binder, said binder is a member selected from the group consisting of polycarbonate resin, polyester resin, polyethylene resin, (meth) acrylic resin, and silicone resin.

14. The photoconductor according to claim 1, wherein said charge generation layer is from about 0.05 μm to about 2.0 μm in thickness.

15. The photoconductor according to claim 1, wherein said charge generating layer includes a member selected from the group consisting of an azo pigment, an anthraquinone pigment, a polycyclic quinone pigment, an indigo pigment, a diphenylmethane pigment, an azine pigment, a cyanine pigment, a perylene pigment, a squalane pigment, and a phthalocyanine pigment.

16. The photoconductor according to claim 15, wherein said charge generating layer further includes a binder, said binder is a member selected from the group consisting of a polyamide resin, a silicone resin, a polyester resin, a polycarbonate resin, a phenoxy resin, a polystyrene resin, a polyvinyl butyral resin, a polyvinyl formal resin, a polyvinyl acetal resin, a (meth) acrylic resin, and a vinyl chloride resin.

* * * * *